United States Patent [19]

Hammett

[11] Patent Number: 4,463,882

[45] Date of Patent: Aug. 7, 1984

[54] ONE-PIECE DISPENSING CLOSURE

[75] Inventor: Roy Hammett, Elburn, Ill.

[73] Assignee: Panamerican Closures, Inc., Pompano Beach, Fla.

[21] Appl. No.: 431,278

[22] Filed: Sep. 30, 1982

[51] Int. Cl.[3] ..... B67D 3/00

[52] U.S. Cl. ..... 222/543; 222/546

[58] Field of Search ..... 222/522, 524, 498, 499, 222/545, 546, 556, 559, 563, 543

[56] References Cited

U.S. PATENT DOCUMENTS

| | | | |
|---|---|---|---|
| 2,696,333 | 12/1954 | Smale | 222/545 |
| 2,931,543 | 4/1960 | Thomas | 222/546 |
| 3,759,429 | 9/1973 | Ardito et al. | 222/546 |
| 4,298,146 | 11/1981 | Montgomery | 222/543 |

*Primary Examiner*—H. Grant Skaggs

*Attorney, Agent, or Firm*—Dennis H. Lambert

[57] ABSTRACT

A one-piece dispensing closure has a laterally oriented dispensing opening therein, communicating with a longitudinal bore. A cap is integrally joined to the closure by a "living" hinge at one side of the cap and closure, and a male plug depends from the underside of the cap in a position to close the longitudinal bore and dispensing opening. The plug has spaced sealing areas thereon which cooperate with spaced sealing areas in the bore, and the cap has a detent on a marginal portion opposite the hinge to retain the cap in a closed position and to also retain the cap in an open position. The detent also effects a seal in the dispensing opening when the cap is in a closed position. Further detents on the cap and closure cooperate to limit opening movement of the cap relative to the closure. Thus, when the cap is closed, primary and secondary seals are provided in both the bore and dispensing opening, and when the cap is open, a seal is maintained in the bore. Further, the cap is detained in predetermined opened and closed positions.

7 Claims, 5 Drawing Figures

ONE-PIECE DISPENSING CLOSURE

BACKGROUND OF THE INVENTION

1. Field of the Invention

This invention relates to closures for containers, and, more particularly, relates to such closures which have a dispensing opening therethrough for dispensing product from the container.

2. Prior Art

Various dispensing closures are known in the prior art, including those shown in U.S. Pat. Nos. 2,919,057 and 3,124,281. U.S. Pat. No. 3,124,281 shows multiple sealing areas and a detent to retain the cap closed, and U.S. Pat. No. 2,919,057 shows detents to limit opening movement of the cap. However, these patents do not teach or suggest the novel construction of the present invention, with its attendant advantages. Other patents of interest are: U.S. Pat. No. 2,322,527, 3,059,816, 3,122,289, 3,240,405, 3,406,909, 3,623,622, 3,762,612, 3,884,390, 4,036,413, 4,241,855, 4,281,778, 4,298,146 and 4,310,105.

SUMMARY OF THE INVENTION

A principal object of the present invention is to provide a one-piece dispensing closure which is simple in construction and effective in operation, in which a cap is hinged to a closure and wherein primary and secondary seals are effected between the cap and closure when the cap is closed.

Another object of the invention is to provide a dispensing closure in which a cap is hinged to the closure and detents are provided to detain the cap in both open and closed positions.

A further object of this invention is to provide a one-piece dispensing closure in which a cap is hinged to a closure and a male plug depends from the underside of the cap in a position to close a dispensing opening through the closure, and wherein the plug effects both primary ahd secondary seals relative to the closure when the cap is closed.

Still another object of the invention is to provide a dispensing closure having a lateral discharge port communicating with a longitudinal bore, and a cap member has a detent thereon which cooperates with the discharge port when the cap is closed to effect both a detaining means and seal.

These and other objects and advantages of the invention are accomplished by a one-piece dispensing closure of simple and economical construction. Briefly, the closure comprises a closure which effects a seal with a container neck and has a cap integrally joined thereto via a living hinge at one side of the closure and cap. A male plug depends from the underside of the cap in a position to cooperate with a longitudinal bore through the closure, and a detent is on a marginal portion of the cap opposite the hinge to cooperate with a laterally oriented discharge port communicating with the bore. Further detent means are on the cap and closure to limit opening movement of the cap relative to the closure, although this detent means may be overcome to permit complete opening movement of the cap to facilitate access to the bore and discharge port for cleaning and the like. Primary and secondary seals are effected relative to the discharge port by a first seal on the plug and by the detent on the cap. Primary and secondary seals are also effected relative to the bore by the first seal on the plug and by a second seal on the plug. When the cap is in an open position relative to the closure, the first seal on the plug also effects a seal in the bore to prevent leakage of material through the bore.

BRIEF DESCRIPTION OF THE DRAWINGS

These and further objects and advantages of the invention will become apparent from the following detailed description taken in conjunction with the drawings, in which.

DETAILED DESCRIPTION OF THE PREFERRED EMBODIMENTS

Figure 2:
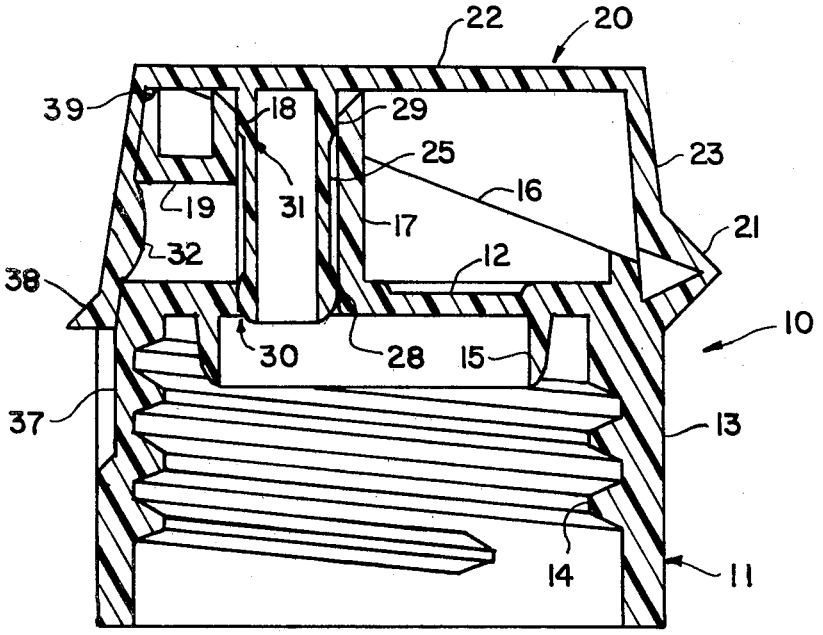
FIG. 2 is a sectional view in elevation, taken along line 2—2 in FIG. 1.
Figure 1:
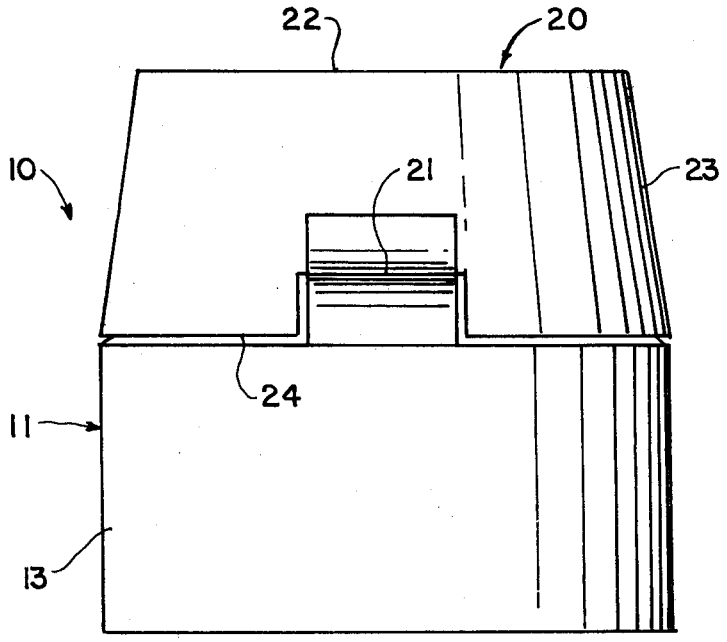
FIG. 1 is a view in elevation of the one-piece dispensing closure of the invention, taken in the direction of the arrow A in FIG. 2.

Referring now more particularly to the drawings, wherein like reference numerals indicate like parts throughout the several views, the one-piece dispensing closure of the invention is indicated generally at 10, and comprises a closure body 11 having a top wall 12 and a depending skirt 13 with a threaded interior 14 for cooperation with like threads on a container neck (not shown). An annular, depending wall 15 is on the inner surface of the top wall 12 for enhancing a seal with the top of the container neck. Other forms of closure securing means may be used rather than the threaded closure securing means shown.

The closure body 11 has an upstanding superstructure or wall 16 above the top wall 12 thereof, tapering from a maximum height at one side of the body to a minimum height at the other side. An upstanding, cylindrical member 17 is formed on the top of the wall 12 adjacent said one side of the body and has a bore 18 therethrough, extending longitudinally relative to the body. A discharge port 19 extends laterally through the wall 16 at said one side of the body, and communicates at its inner end with the bore 18.

A cap 20 is integrally joined to the body 11 by a "living" hinge 21 at said other side of the body, and comprises a top wall 22 with a depending skirt 23 having a bottom marginal edge 24. A hollow male plug 25 depends from the underside of the top wall 22 of the cap in a position to extend into the bore 18.

The upper end of the cylindrical member 17 is tapered or funnel shaped at 26 to facilitate entry of the end of the male plug 25 into the bore 18. The plug itself has a reduced diameter portion 27 between the ends thereof, defining a pair of spaced sealing areas 28 and 29 thereon for cooperation with the inner surface of cylindrical member 17 defining the bore 18. Thus, when the cap is in the fully closed position shown in FIG. 2 both a primary and a secondary seal are formed in the bore 18. The primary seal 30 is effected ahead of the discharge port 19, while the secondary seal 31 is effected at the outer end of the bore 18. It should be noted that the primary sealing area 28 is spherically shaped to obtain maximum sealing effectiveness. When the cap is moved to its open position as shown in FIG. 3, the primary sealing area 28 on plug 25 is disposed at the outer end of the bore 18, effecting a seal therewith.

Figure 3:
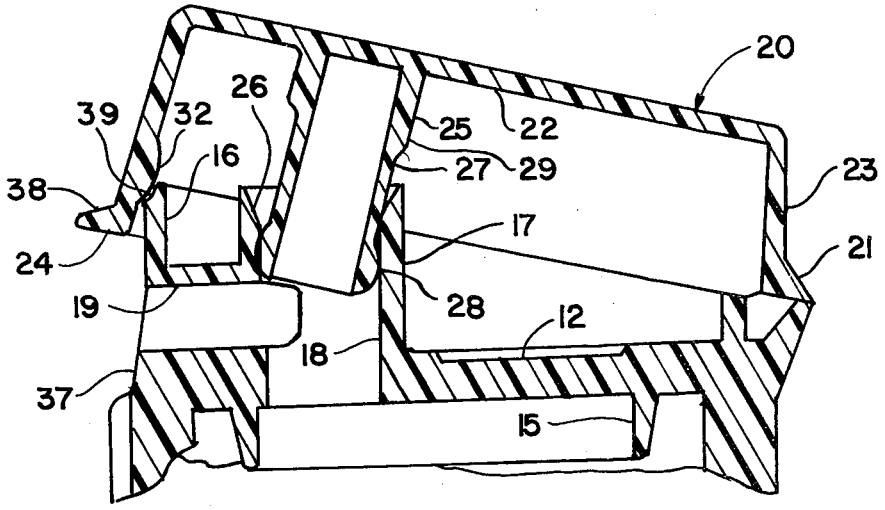
FIG. 3 is a fragmentary sectional view in elevation, similar to FIG. 2, showing the cap in an open position relative to the closure.

The inner marginal surface of skirt 23 of cap 20 has a rounded protruberance or detent 32 thereon in a position to cooperate with the discharge port 19 when the cap is in the closed position of FIG. 2, to both detain the cap in the closed position and to effect a seal with the discharge port. Thus, in the closed position of the cap, both primary and secondary seals are effected with the discharge port or path (at 30 and 32).

A pair of lugs or detents 33 and 34 are formed on the bottom edge of the skirt 23 on opposite sides of the sealing detent 32, for cooperation with stops 35 and 36 formed on the closure to limit opening movement of the cap relative to the closure. The outer surface of the closure body 11 is recessed at 37 to facilitate access to a lip or finger grip 38 on the bottom edge of skirt 23 whereby the cap may be lifted from its closed position to the open position. It should further be noted that a recess 39 is formed in the top of wall 16, which serves as a rest for the protruberance 32 to detain the cap 20 in its open position.

Figure 4:
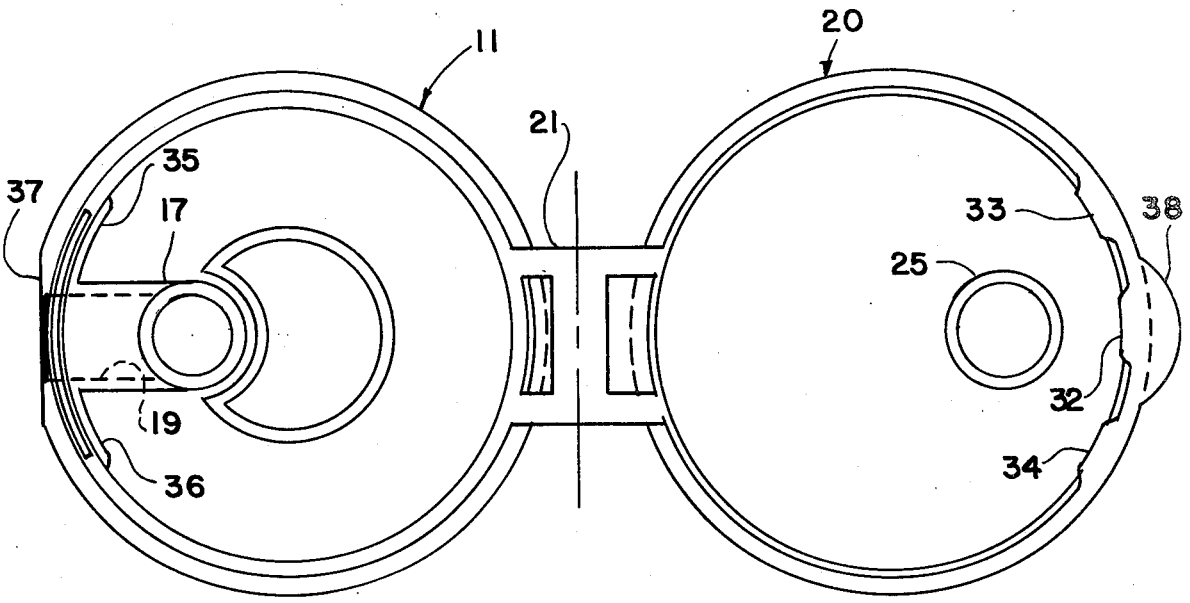
FIG. 4 is a plan view of the closure, with the cap in a fully opened position.
Figure 5:
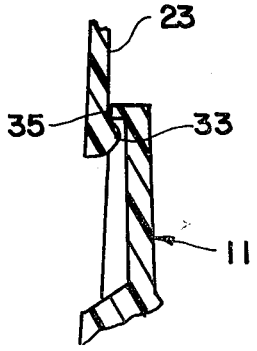
FIG. 5 is a fragmentary, sectional view of one of the detent means to limit opening movement of the cap and is taken along line 5—5 in FIG. 4.

The one-piece closure may be made of any suitable material, such as thermoplastic and the like, and the closure may be made in various sizes and designs, with different size bores and discharge ports. Morever, if a thixotropic product is used and the bore or discharge port becomes clogged, the cap may be opened completely (as shown in FIG. 4, for example) to expose the bore and discharge port for mechanical cleaning.

While the present invention has been described in association with a particular preferred embodiment, those skilled in the art will appreciate that such embodiment is susceptible to changes and substitutions of equivalents without departing from the scope of the present invention. Consequently, it is intended that the herein disclosed invention be defined in the following claims.

What is claimed is:

1. A one-piece dispensing closure, comprising:

a closure body having means thereon for attachment to a container, said closure body having a bore therethrough and a discharge port in communication with the bore;

a cap integrally joined to the closure body and movable into and away from a closed position overlying the closure body;

an elongate plug member carried by the cap in a position to cooperate with the bore and effect a seal therewith when the cap is in the closed position, said plug member having spaced sealing areas thereon for effecting both a primary and a secondary seal in the bore when the cap is in its closed position, said primary seal being disposed ahead or upstream of the discharge port; and detent and seal means on the cap cooperable with complemental means on the closure body to detain the cap in both its open and closed positions, said detent and seal means cooperating with the discharge port to effect a seal therewith when the cap is in its closed position, whereby multiple seals are effected relative to both the bore and the discharge port when the cap is closed.

2. A one-piece dispensing closure as defined in claim 1, wherein:

one of said sealing areas of the plug member is effective to maintain a seal in the bore when the cap is in its open position.

3. A one-piece dispensing closure as defined in claim 2, wherein:

said bore extends longitudinally of the closure body and said discharge port opens laterally therethrough.

4. A one-piece dispensing closure as defined in claim 3, wherein:

limit stop means are on the cap and closure body to limit opening movement of the cap relative to the closure body to maintain the plug member in the bore.

5. A one-piece dispensing closure as defined in claim 2, wherein:

the detent and seal means is spherically shaped.

6. A one-piece dispensing closure as defined in claim 5, wherein:

the primary and secondary seal areas on the plug member are formed by a recessed area on the outer surface of the plug member, said primary seal area being at the free end of the plug member and having a convex, spherical shape.

7. A one-piece dispensing closure as defined in claim 1, wherein:

the closure body comprises a top wall having a depending annular skirt on the bottom thereof and an upstanding wall on the top thereof;

a longitudinally extending cylindrical member on the top wall, said bore being formed longitudinally through said cylindrical member, and said discharge port extending laterally through said upstanding wall into communication with the bore;

said cap having a top wall and a depending annular skirt and joined to said closure body by an integral hinge at one side thereof;

said plug member depending from the top wall of the cap in a position to enter the bore and effect a seal therewith and having a recessed area between its ends to define the spaced primary and secondary sealing areas, said primary sealing area being spherically shaped for seal enhancement;

said detent and seal means being on the lower inner surface of the cap depending skirt and disposed in a position to enter the discharge port when the cap is closed to effect a seal therewith and to detain the cap in the closed position; and limit stop means on the cap and closure body to limit opening movement of the cap.

* * * * *